US006453583B1

(12) United States Patent
Hanafusa et al.

(10) Patent No.: US 6,453,583 B1
(45) Date of Patent: Sep. 24, 2002

(54) WALK BEHIND SELF-PROPELLED CRAWLER SNOWPLOW

(75) Inventors: Jitsumi Hanafusa, Wako (JP); Kenji Kuroiwa, Wako (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 49 days.

(21) Appl. No.: 09/816,528

(22) Filed: Mar. 23, 2001

(30) Foreign Application Priority Data

Mar. 27, 2000 (JP) ..... 2000-086471

(51) Int. Cl.[7] ..... E01H 5/09; F01H 5/09

(52) U.S. Cl. ..... 37/246; 37/243

(58) Field of Search ..... 37/221, 222, 227, 37/241–243, 246–249, 253, 254, 256, 257, 250, 251; 180/9.21, 9.26, 9.28, 9.3, 68.5; 74/89.22; 439/500, 682

(56) References Cited

U.S. PATENT DOCUMENTS 4,321,991 A 3/1982 Teijido et al. ..... 190/0.034
4,532,725 A * 8/1985 Trejo et al. ..... 37/243
5,438,770 A * 8/1995 Miller ..... 37/227
6,035,561 A * 3/2000 Paytas et al. ..... 180/68.5
6,170,179 B1 * 1/2001 Paytas et al. ..... 180/68.5

FOREIGN PATENT DOCUMENTS

JP 63223207 9/1988
JP 08013439 1/1996

* cited by examiner

*Primary Examiner*—Robert E. Pezzuto
(74) *Attorney, Agent, or Firm*—Adams & Wilks

(57) ABSTRACT

A walk behind self-propelled crawler snowplow includes a snowplow mechanism disposed on a front portion of a vehicle body, an engine disposed on a longitudinal central portion of the vehicle body for driving the snowplow mechanism, a left crawler belt and a right crawler belt disposed on a left side and a right side, respectively, of the vehicle body, and left and right electric motors disposed on a rear portion of the vehicle body for driving the left and right crawler belts, respectively. With this arrangement, the crawler snowplow has a good weight balance such that the load or weight of the vehicle body is born evenly by the crawler belts. Since the snowplow mechanism and the crawler belts are driven separately by different power sources, the crawler snowplow can exhibit a good traveling performance regardless of the load exerted on the snowplow mechanism.

13 Claims, 6 Drawing Sheets

WALK BEHIND SELF-PROPELLED CRAWLER SNOWPLOW

BACKGROUND OF THE INVENTION

The present invention relates to an improvement in a walk behind self-propelled crawler snowplow.

In recent years, an auger-type self-propelled snowplow maneuverable by a human operator walking behind the snowplow has been used extensively as it can reduce labor in a snow removing work in a relatively small area. One example of such conventional walk behind self-propelling snowplow is disclosed in Japanese Patent Laid-open Publication No. (Sho) 63-223207.

The disclosed snowplow is equipped with an auger and an impeller disposed on a front portion of a vehicle body, an engine disposed on a central portion of the vehicle body, left and right handlebars connected to a rear portion of the vehicle body, and left and right crawler belts disposed on left and right sides of the vehicle body.

The engine drives the auger and impeller via an auger clutch. The engine also drives the crawler belts via a mechanical propelling clutch, a transmission, and left and right driving sprockets. Thus, a snowplow mechanism including the auger and impeller and a propelling mechanism including the crawler belts are both driven by a single prime motor comprised of the engine.

In general, in the walk behind self-propelled snowplow, power from the single engine is distributed to the snowplow mechanism and the propelling mechanism at the ratio of about 9:1. More specifically, the power ratio divided between the auger, impeller and propeller mechanism is about 2:7:1.

In spite of its small power consumption, the propelling mechanism of the conventional snowplow requires a power transmission mechanism which is large in size and complicated in construction as it includes the above-mentioned mechanical propelling clutch and transmission. Due to such large and complicated propelling power transmission system, the clutch onoff operation, speed change operation and vehicle turning operation are tedious and require a relatively large muscular effort.

Furthermore, there has been a keen demand for a snowplow with good weight balance leading to improved maneuverability of the snowplow. To this end, the arrangement of a power source including a propelling power transmission system forms a major requirement in designing a walk behind self-propelled crawler snowplow.

SUMMARY OF THE INVENTION

It is accordingly an object of the present invention to provide a walk behind self-propelled crawler snowplow with good weight balance and improved maneuverability.

To achieve the foregoing object, there is provided according to the present invention a walk behind self-propelled crawler snowplow comprising: a vehicle body; a snowplow mechanism disposed on a front portion of the vehicle body, the snowplow mechanism including an auger; an engine disposed on a longitudinal central portion of the vehicle body for driving the snowplow mechanism; a left crawler belt and a right crawler belt disposed on a left side and a right side, respectively, of the vehicle body; and left and right electric motors disposed on a rear portion of the vehicle body for driving the left and right crawler belts, respectively.

Since the snowplow mechanism and the electric motors are disposed on opposite longitudinal end portions of the vehicle body with the engine disposed on a longitudinal central portion of the vehicle body, the crawler snowplow has a good weight balance such that the load or weight of the vehicle body is evenly born by the left and right crawler belts disposed on opposite sides of the vehicle body. This improves the maneuverability of the crawler snowplow.

Furthermore, the electric motors disposed on the left and right sides, respectively, of the rear portion of the vehicle body act as a counterbalance to the snowplow mechanism disposed on the front portion of the vehicle body. With this counterbalancing, the crawler snowplow can easily ride across and wedge through snow, thus showing a good breakthrough performance on the snow.

Because the snowplow mechanism, which shears about 90% of the overall necessary power of the crawler snowplow, and the propelling mechanism (crawler belts ), which shears about 10% of the overall necessary power, are driven separately by different power sources, the crawler snowplow can exhibit its driving performance regardless of the condition of load exerted on the snowplow mechanism. In addition, since the left and right electric motors are separately controllable, electrically controlling of the rotational speed of the individual electric motors enables smooth and easy speed change and turning operations of the crawler snowplow.

In one preferred from of the present invention, the walk behind self-propelled crawler snowplow further includes a pair of left and right operation handlebars extending from the rear portion of the vehicle body obliquely upward in a rearward direction of the crawler snowplow, a control unit mounted to the operation handlebars at a higher level than the crawler belts for controlling operation of the electric motors, and a battery mounted to the operation handlebars at a higher level than the crawler belts for supplying electric power to the electric motors.

Since the control unit and battery are arranged more backward than the vehicle body, a fine adjustment of the longitudinal weight balance of the crawler snowplow becomes possible, which insures an improved breakthrough performance of the crawler snowplow. The control unit and battery located at higher levels than the crawler belts are protected from damage or deterioration with snow.

Preferably, the control unit and the battery are disposed in a vertical space defined between the left and right handlebars. The control unit is preferably disposed above the battery.

It is preferable that the vehicle body is composed of a propelling frame supporting thereon the left and right crawler belts and the left and right electric motors, a vehicle frame pivotally connected at a rear end portion thereof to a rear portion of the propelling frame and supporting thereon the snowplow mechanism and the engine, and a frame lift mechanism connected to the propelling frame and the vehicle frame and operable to move a front end portion of the vehicle frame up and down relative to the propelling frame. The frame lift mechanism may be a cylinder actuator having a cylinder tube pivotally connected to the propelling frame and a reciprocating piston rod pivotally connected to the vehicle frame.

Preferably, the left crawler belt is trained around a left driving wheel and a left idler wheel, the right crawler belt is trained around a right driving wheel and a right idler wheel, the left and right idler wheels are fixed on opposite ends of a front axle rotatably supported on a front end portion of the propelling frame, the left electric motor is a geared motor mounted to a rear end portion of the propelling frame on the left side of the vehicle body and having an output shaft on which the left driving wheel is fixed, and the right electric motor is a geared motor mounted to the rear end portion of the propelling frame on the right side of the vehicle body and having an output shaft on which the right driving wheel is fixed. By using the geared motors, a propelling power transmission system for transmitting power from the motors to the respective crawler belts is considerably small in construction and contributes downsizing of the snowplow.

It is preferable that the front end portion of the propelling frame has a horizontal slot extending in the longitudinal direction of the vehicle body and slidably receiving therein a longitudinal portion of the front axle, and a tension adjustment device is associated with the propelling frame and operative to move the front axle along the horizontal slot to thereby adjust a tension in the crawler belts.

The above and other objects, features and advantages of the present invention will become manifest to those versed in the art upon making reference to the following description and accompanying sheets of drawings in which a certain preferred structural embodiment incorporating the principle of the invention is shown by way of illustrative example.

DETAILED DESCRIPTION OF THE PREFERRED EMBODIMENT

The following description is merely exemplary in nature and is in no way intended to limit the invention or its application or use.

Figure 1:
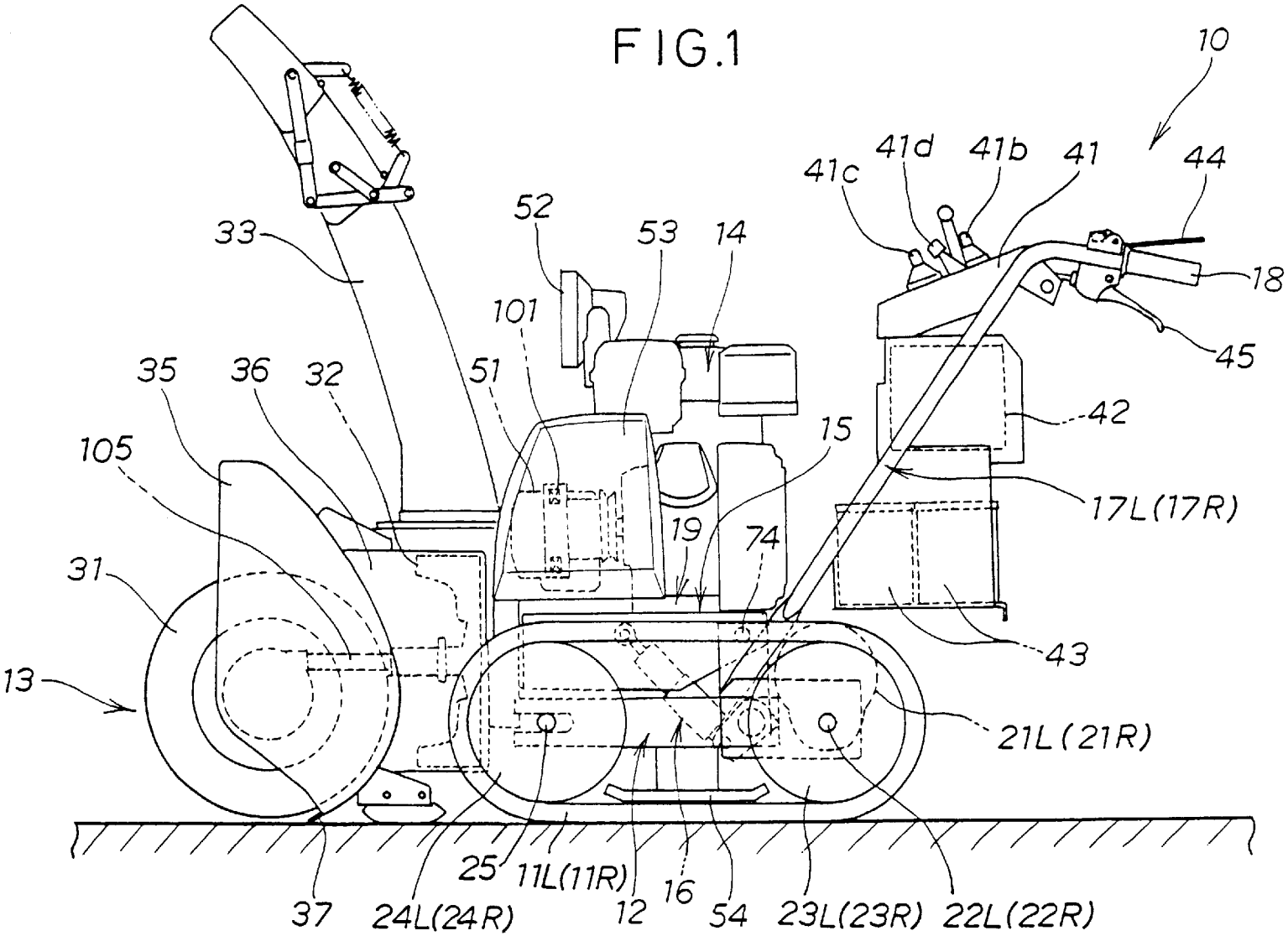
FIG. 1 is a left side view of a walk behind selfpropelled crawler snowplow according to an embodiment of the present invention.

Referring to the drawings and FIG. 1 in particular, there is shown a walk behind self-propelled crawler snowplow 10 according to an embodiment of the present invention. The snowplow 10 generally comprises a propelling frame 12 carrying thereon left and right crawler belts (only the left crawler belt 11L being shown), a vehicle frame 15 carrying thereon a snowplow mechanism 13 and an engine (prime motor) 14 for driving the snowplow mechanism 13, a frame lift mechanism 16 operable to lift a front end portion of the vehicle frame 15 up and down relative to the propelling frame 12, and a pair of left and right operation handlebars 17L and 17R extending from a rear portion of the propelling frame 12 obliquely upward in a rearward direction of the snowplow 10. The propelling frame 12 and the vehicle frame 15 jointly form a vehicle body 19.

The left and right crawler belts 11L, 11R are driven by left and right electric motors 21L, 21R (only right one being shown), respectively. The crawler belts 11L, 11R are each trained around a driving wheel 23L, 23R and an idler wheel 24L, 24R. The driving wheel 23L, 23R is disposed on a rear side of the crawler belt 11L, 11R, and the idler wheel 24L, 24R is disposed on a front side of the crawler belt 11L, 11R.

The snowplow mechanism 13 has an auger 31, a blower 32 and a discharge duct 33 that are mounted to a front portion of the vehicle frame 15. In operation, the auger 31 rotates to cut snow away from a road, for example, and feed the cut mass of snow to the blower 32 which blows out the snow through the discharge duct 33 to a position far distant from the snowplow 10.

The operation handlebars 17L, 17R are gripped by a human operator (not shown) walking behind the snowplow 10 in order to maneuver the snowplow 10. A control board 41, a control unit 42 and batteries 43 are arranged in a vertical space defined between the handlebars 17L, 17R and they are mounted to the handlebars 17L, 17R in the order named when viewed from the top to the bottom of FIG. 1.

The operation handlebars 17L, 17R each have a grip 18 at the distal end (free end) thereof. The left handlebar 17L has a clutch lever 44 disposed in close proximity to a grip 18 so that the human operator can manipulate the clutch lever 44 to turn on and off (or engage and disengage) an electromagnetic clutch 101 while maintaining an appropriate grip on the grip 18. The left and right handlebars 17L, 17R further have turn control levers 45 associated with the respective grips 18, 18.

The crawler snowplow 10 of the foregoing construction is self-propelled by the crawler belts 11L, 11R driven by the electric motors 21L, 21R and is also maneuvered by the human operator walking behind the snowplow 10 while handling the handlebars 17L, 17R.

In FIG. 1 reference numeral 35 denotes an auger case, numeral 36 denotes a blower case, numeral 37 denotes a scraper formed integrally with a lower edge of the auger case 35, numeral 51 denotes a charging generator for charging the batteries 43, numeral 52 denotes a lamp, numeral 53 denotes a cover for protecting the generator 51 and the electromagnetic clutch 101, and numeral 54 denotes a stabilizer for urging each crawler belt 11L, 11R downward against the ground surface.

It appears clear from the foregoing description that the snowplow mechanism 13 is disposed on a front portion of the vehicle body 19, the engine 14 for driving the snowplow mechanism 13 is disposed on a longitudinal central portion of the vehicle body 19, the crawler belts 11L, 11R are disposed on left and right sides of the vehicle body 19, the electric motors 21L, 21R for driving the corresponding crawler belts 11L, 11R are disposed on a rear portion of the vehicle body 19, the left and right operation handlebars 17L, 17R extend from the rear portion of the vehicle body 19 obliquely upward in a rearward direction of the snowplow, and the control board 41, control unit 42 and batteries 43 are located at higher levels than the crawler belts 11L, 11R.

Figure 2:
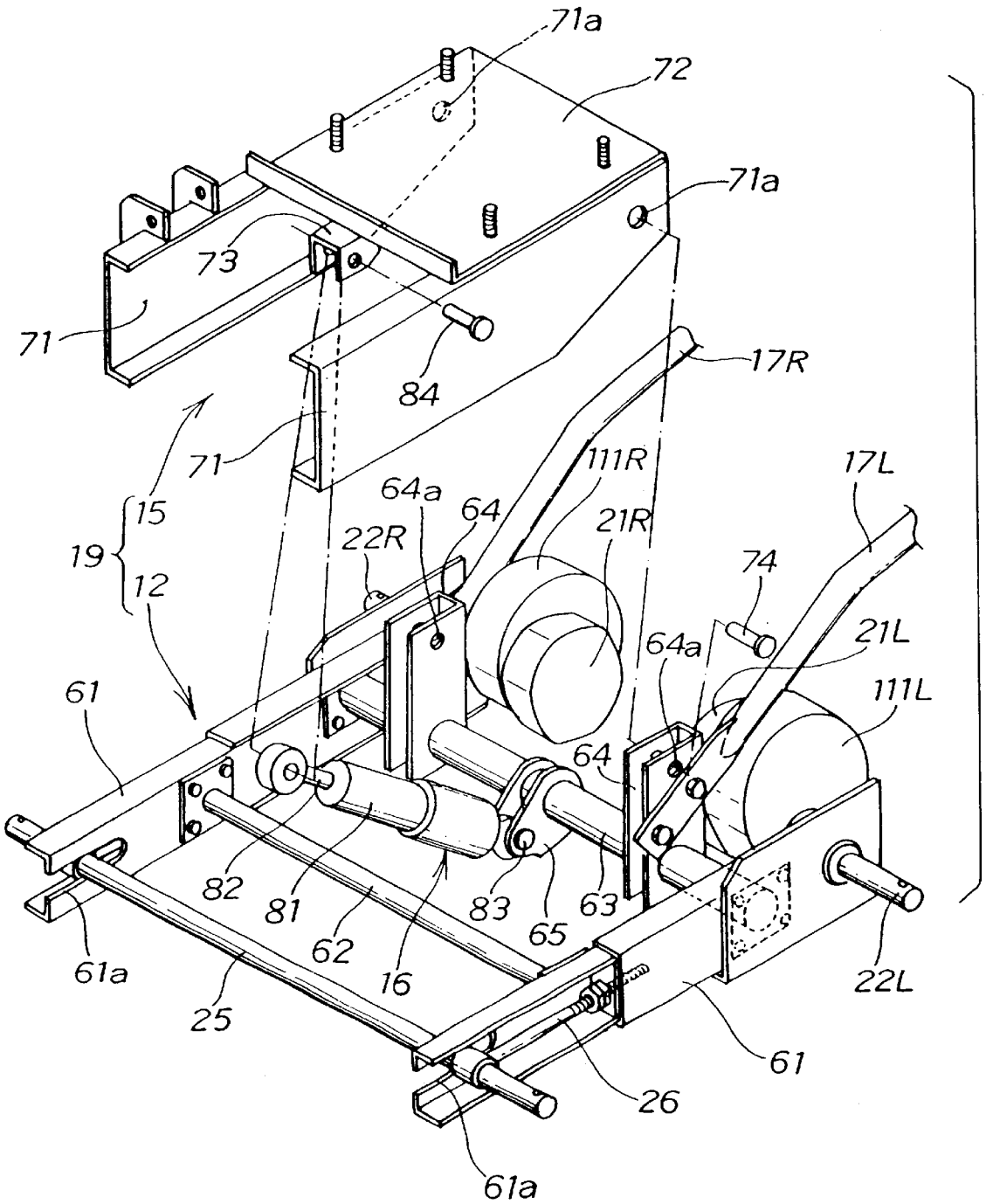
FIG. 2 is an exploded perspective view showing a propelling frame, a vehicle frame and a frame lift mechanism of the crawler snowplow.

As shown in FIG. 2, the propelling frame 12 is composed of a pair of parallel spaced left and right side members 61, 61 extending in the longitudinal direction of the vehicle body 19, a front cross member 62 interconnecting respective front portions of the side members 61, 61, and a rear cross member 63 interconnecting respective rear portions of the side members 61, 61. The propelling frame 12 further has a pair of side brackets 64, 64 connected to left and right end portions of the rear cross member 63 adjacent to the side members 61, and a central bracket 65 connected to a central portion the rear cross member 63 which corresponds in position to a widthwise or crosswise central portion of the propelling frame 12.

The electric motors 21L, 21R are mounted to respective rear end portions of the side members 61, 61. Respective front end portions of the side members 61, 61 have a longitudinal slot 61*a* for receiving therein a longitudinal portion of a front axle 25 so that the front axle 25 is rotatably supported on the front end portions of the side members 61, 61. The front axle 25 is movable in the longitudinal direction of the side frames 61, 61 along the slots 61*a* when tension adjustment devices or bolts 25 associated with the respective side frames 61 is actuated. By thus moving the front axle 25, the tension in each crawler belt 11L, 11R can be adjusted.

The left and right side brackets 64 are each comprised of a vertically extending channel member having a U-shaped cross section. The left and right handlebars 17L, 17R have respective lower end portions bolted to the opposite outer sides of the left and right side brackets 64. The side brackets 64 each have a horizontal through-hole 64*a* formed in an upper end portion thereof.

The vehicle frame 15 is comprised of a pair of parallel spaced left and right side members 71, 71 extending in the longitudinal direction of the vehicle body 19, and a horizontal mount base 72 extending between the side members 71, 71 astride a rear half of the side members 71 for mounting the engine 14. The vehicle frame 15 also has a support arm 73 connected to a central portion of the front edge of the mount base 72. The side members 71 each have a horizontal through-hole 71*a* formed in a rear end portion thereof.

The vehicle frame 15 is pivotally connected to the propelling frame 12 by means of pivot pins 74 (one being shown) inserted successively through the horizontal holes 64*a* in the side brackets 64 and the horizontal holes 71*a* in the side members 71. With this pivotal connection, a front end portion of the vehicle frame 15 is movable up and down in a vertical plane relative to the propelling frame 12.

The frame lift mechanism 16 has a cylinder actuator including a cylinder tube 81 and a piston rod 82 reciprocally movable to project from or retract into the cylinder tube 81. The front end of the rod 82 is pivotally connected by a pin 84 to the support arm 73 of the vehicle frame 15, and the rear end of the cylinder tube 81 is pivotally connected by a pin 83 to the central bracket 65 of the propelling frame 12. With this arrangement, the vehicle frame 15 is movable to swing in the vertical plane about the pivoted rear end portion thereof in response to activation and de-activation of the cylinder actuator (frame lift mechanism) 16. The cylinder actuator may be a hydraulic actuator, a pneumatic actuator or an electric linear actuator.

Figure 3:
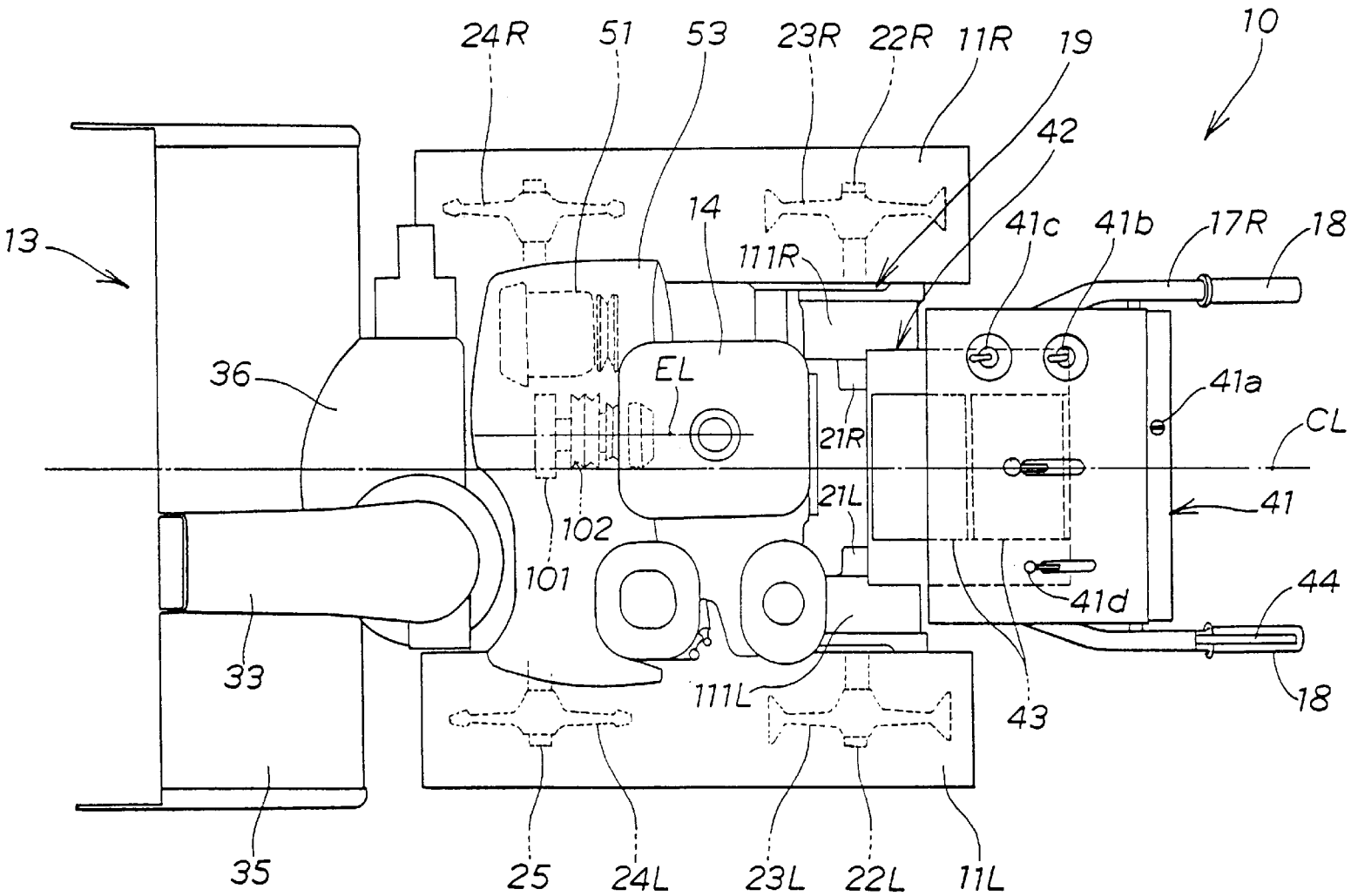
FIG. 3 is a plan view of the crawler snowplow.

As shown in FIG. 3, the engine 14 is disposed on a longitudinal central portion of the vehicle body 19 with the axis EL of an output shaft 14A (FIG. 4) being slightly offset rightward from a longitudinal centerline CL of the vehicle body 19. The control board 41 has a main switch (key switch) 41*a*, a lift control lever 41*b* for controlling operation of the frame lift mechanism 16 (FIG. 3), a duct control lever 41*c* for changing direction of the discharge duct 41*c*, and a speed control lever 41*d* for controlling the speed and direction of the electric motors 21L, 21R.

Figure 4:
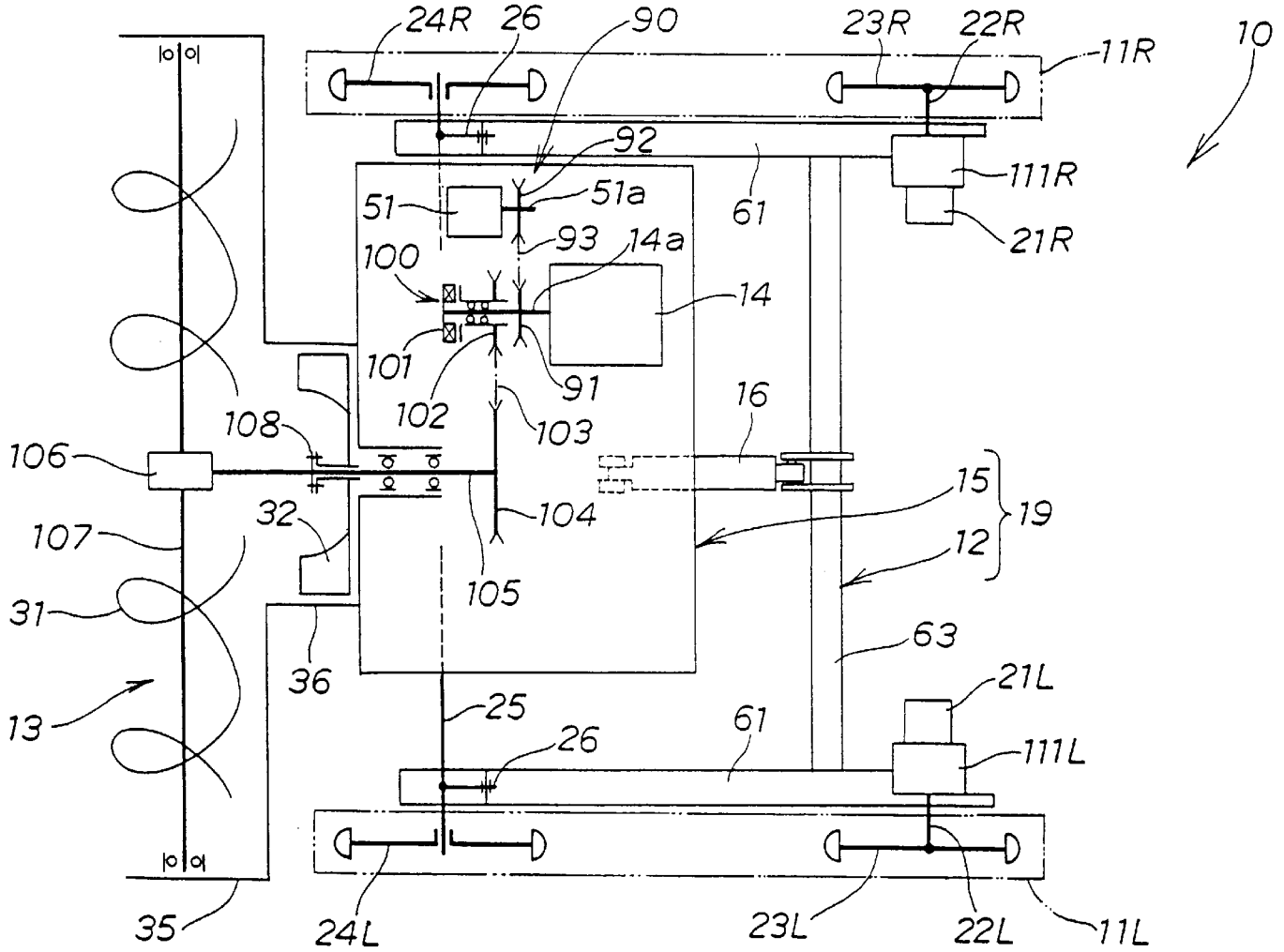
FIG. 4 is a diagrammatical view showing the arrangement of an engine, electric motors, a snowplow mechanism and crawler belts of the crawler snowplow.

FIG. 4 diagrammatically shows a power transmission system of the crawler snowplow 10. As shown in this figure, power from the engine 14 is transmitted to the generator 51 through a charge power transmission system 90 and also to the snowplow mechanism 13 through a snowplow power transmission system 100.

The charge power transmission system 90 has a first driving pulley 91 connected to the output shaft 14*a* of the engine 14, a first driven pulley 92 connected to a shaft 51*a* of the generator 51, and a first endless belt 93 connecting the driving pulley 91 and the driven pulley 92. When the engine 51 is running, the generator 51 is driven via the charging power transmission system 90 so that the batteries 43 (FIG. 3) are charged with electric current supplied from the generator 51.

The snowplow power transmission system 100 includes a second driving pulley 102 coupled via the electromagnetic clutch 101 to the output shaft 14*a* of the engine 14, a second driven pulley 104 connected to one end of a rotating shaft 105, a second endless belt 103 connecting the driving pulley 102 and the driven pulley 104, and a worm gear speed reducing mechanism 106 connected to the other end of the rotating shaft 105.

The rotating shaft 105 is connected to a shaft 107 of the auger 31 via the worm gear speed reducing mechanism 106. The rotating shaft 105 is also connected to a shaft (not designated) of the blower 32 via a coupling 108. While the engine 14 is running, the auger 31 and blower 32 are drivable through the snowplow power transmission system 100 when the electromagnetic clutch 101 is in the engaged state.

Power from the left and right electric motors 21L, 21R is transmitted to the left and right crawlers 11L, 11R respectively through left and right propelling power transmission systems 11L, 11R.

The left propelling power transmission system 111L is comprised of a speed reducer including a set of reduction gears connected to the left electric motor 21L. The speed reducer 111L has an output shaft 22L firmly connected to the left driving wheel 23L and thus serving as an left driving axle. With this arrangement, when the left electric motor 21L is driven in rotation, power from the motor 21L is transmitted via the left propelling power transmission system 111L to the left driving axle 22L and thence to the left driving wheel 23L, hereby driving the left crawler belt 11L.

Similarly, the right propelling power transmission system 111R is comprised of a speed reducer including a set of reduction gears connected to the right electric motor 21R. The speed reducer 111R has an output shaft 22R connected to the right driving wheel 23R and thus serving as a right driving axle. When the right electric motor 21R is driven in rotation, power from the motor 21R is transmitted via the right propelling power transmission system 111R to the right axle 22R and thence to the right driving wheel 23R, thereby driving the right crawler belt 11R.

Thus, each of the left and right electric motors 21L, 21R assembled with the corresponding speed reducer (reduction gear set) 11L, 111R forms a so-called "geared motor" having an output shaft 22L, 22R serving as a rear axle on which the associated driving wheel 23L, 23R is fixed.

Figure 5:
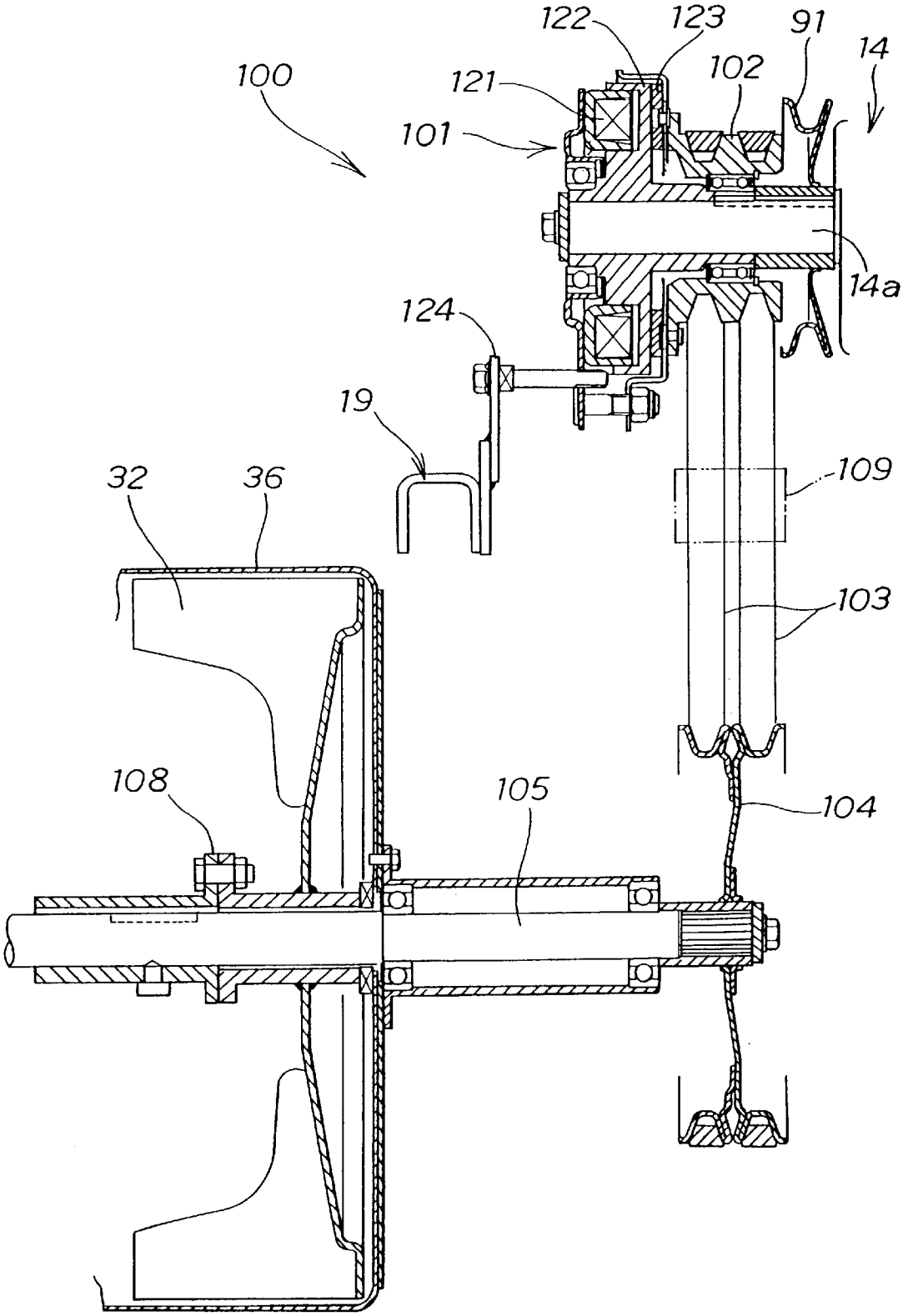
FIG. 5 is a cross-sectional view showing a power transmission system for driving the snowplow mechanism.

As shown in FIG. 5, the electromagnetic clutch 101 is comprised of an electromagnet 121 non-rotatably connected to the vehicle body 19 via a magnet support member 124, a disc 122 firmly connected to the output shaft 14*a* of the engine 14, and clutch plate 123 disposed in confrontation to a friction surface (not designated) of the disc 122 with a small air gap defined therebetween. The clutch plate 123 is connected to the second driving pulley 102 so that the electromagnetic clutch 101 is assembled with or built in the second driving pulley 102. The electromagnet 121 is normally de-energized so that the clutch 101 is normally disposed in the disengaged state in which the second driving pulley 102 is disengaged from the output shaft 14*a* of the engine 14. when the electromagnet 121 is energized, he clutch plate 123 is attracted to the disc 122, thereby engaging the clutch 101. The second driving pulley 102 is thus connected to the output shaft 14*a* of the engine 14 so that power from the engine 14 is transmitted to the connecting shaft 105 and thence to the auger 31 (FIG. 4) and blower 32 of the snowplow mechanism 13.

As shown in FIG. 5, the second driving and driven pulleys 102 and 104 are double grooved pulleys. The rotating shaft 105 is rotatably supported by the blower case 36 via roller bearings (not designated). Reference numeral 109 denotes a tension roller for applying a proper tension to the belts 103.

Figure 6:
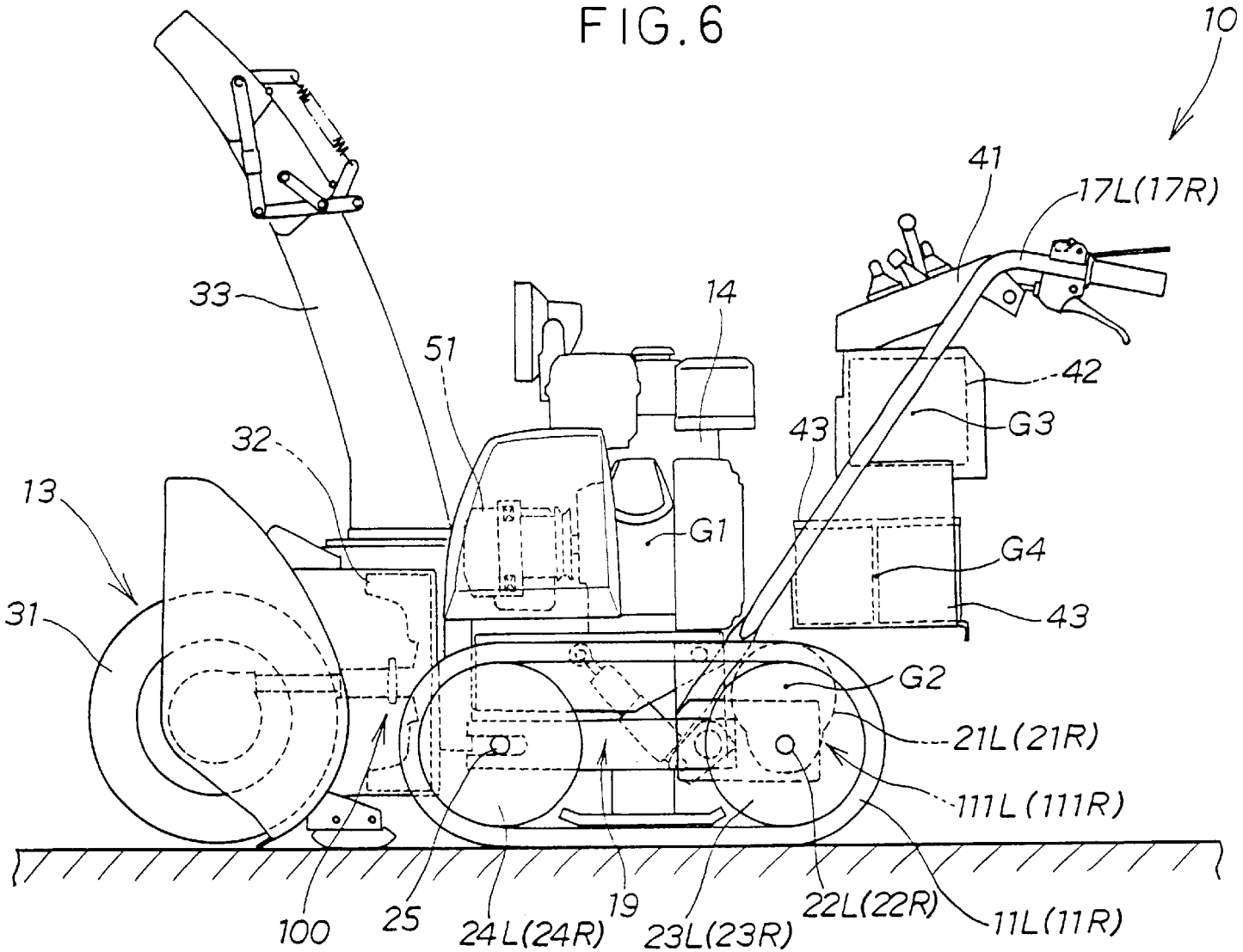
FIG. 6 is a side view showing the positional relationship between main components of the snowplow.

FIG. 6 shows the positional relationship between the main components of the crawler snowplow 10 when viewed in side elevation. As shown in this figure, the center of gravity G1 of the engine 14 is located between the axis 25 of the idler rollers 24L, 24R and the axles 22L, 22R of the driving wheels 23L, 23R. The center of gravity G2 of each motor 21L, 21R is located above the corresponding axle 22L, 22R of the driving wheel 23L, 23R. The center of gravity G3 of the control unit 42 and the center of gravity of the batteries 43 are located more rearward than the driving axles 22L, 22R. The centers of gravity G1, G3 and G4 are located at higher levels than the crawler belts 11L, 11R.

Since the snowplow mechanism 13 and the electric motors 21L, 21R are disposed on opposite longitudinal end portions of the vehicle body 19 with the engine 14 (which is a heavy component) disposed on a longitudinal central portion of the vehicle body 19, the crawler snowplow 10 has a good weight balance such that the load or weight of the vehicle body 19 is evenly born by the left and right crawler belts 11L, 11R disposed on opposite sides of the vehicle body 19. This improves the maneuverability of the crawler snowplow 10.

Furthermore, the electric motors 21L, 21R disposed on the left and right sides, respectively, of the rear portion of the vehicle body 19 act as a counterbalance to the snowplow mechanism 13 disposed on the front portion of the vehicle body 19. With this counterbalancing, the crawler snowplow 10 can easily ride across and wedge through snow, exhibiting a good breakthrough performance on the snow.

The snowplow mechanism 19, which shears about 90% of the total necessary power of the crawler snowplow, is driven by the engine 14, and the propelling mechanism (crawler belts 11L, 11R), which shears about 10% of the total necessary power, is driven by the left and right electric motors 21L, 21R. The engine 14 has a high power efficiency (the amount of power generated per unit weight), and the electric motors 21L, 21R have good controllability. By thus separating the power source depending on the amount of the necessary, power, the crawler snowplow can enjoy both the advantage (i.e., high power efficiency) peculiar to the engine 14 and the advantage (i.e., good controllability) peculiar to the electric motors 21L, 21R at one time.

By virtue of the use of separate power sources, the crawler snowplow 10 can exhibit good traveling performance regardless of the condition of load exerted on the snowplow mechanism 13.

Additionally the crawler snowplow 10 is self-propelled with the crawler belts 11L, 11R by using the electric motors 21L, 21R of a relatively low power output, which motors are small in size hence have a high degree of freedom in layout.

Furthermore, the propelling power transmission systems 111L, 111R for transmitting power from the associated electric motors 21L, 21R to the corresponding crawler belts 11L, 11R are assembled integrally with the electric motors 21L, 21R. The propelling power transmission systems 111L, 111R are, therefore, simple in construction, small in size and light in weight as compared to the complicated heavy propelling power transmission system due for transmitting power from the engine to the crawler belts in the conventional crawler snowplow. The propelling power transmission systems 111L, 11R contribute downsizing and cost-reduction of the crawler snowplow 10.

The left and right electric motors 21L, 21R are separately controllable. Accordingly, by electrically controlling rotational speed of the individual electric motors 21L, 21R, speed change operation and turning operation of the crawler snowplow 10 can be easily achieved with a smaller muscular effort than as required in the engine-driven propelling mechanism of the conventional crawler snowplow.

Additionally, the left and right operation handlebars 17L, 17R extend from a rear portion of the vehicle body 19 obliquely upward in a rearward direction of the crawler snowplow 10, and the control board 41, control unit 42 and batteries 43 are mounted to the handlebars 17L, 17R at levels higher than the crawler belts 11L, 11R. Since the control unit 42 and batteries 43 are arranged more backward than the vehicle body 19, this arrangement facilitates fine adjustment of the longitudinal weight balance of the crawler snowplow 10, which insures an improved breakthrough performance of the crawler snowplow. The control unit 42 and batteries 43 located at higher levels than the crawler belts 11L, 11R are protected from damage or deterioration with snow.

Obviously, various minor changes and modifications of the present invention are possible in the light of the above teaching. It is therefore to be understood that within the scope of the appended claims, the present invention may be practiced otherwise than as specifically described.

What is claimed is:

1. A walk behind self-propelled crawler snowplow comprising:

a vehicle body;

a snowplow mechanism disposed on a front portion of the vehicle body, the snowplow mechanism including an auger;

an engine disposed on a longitudinal central portion of the vehicle body for driving the snowplow mechanism;

a left crawler belt and a right crawler belt disposed on a left side and a right side, respectively, of the vehicle body; and left and right electric motors disposed on a rear portion of the vehicle body for driving the left and right crawler belts, respectively.

2. The walk behind self-propelled crawler snowplow according to claim 1, further comprising a pair of left and right operation handlebars extending from the rear portion of the vehicle body obliquely upward in a rearward direction of the crawler snowplow, a control unit mounted to the operation handlebars at a higher level than the crawler belts for controlling operation of the electric motors, and a battery mounted to the operation handlebars at a higher level than the crawler belts for supplying electric power to the electric motors.

3. The walk behind self-propelled crawler snowplow according to claim 2, wherein the control unit and the battery are disposed in a vertical space defined between the left and right handlebars.

4. The walk behind self-propelled crawler snowplow according to claim 2, wherein the control unit is disposed above the battery.

5. The walk behind self-propelled crawler snowplow according to claim 1, wherein the left crawler belt is trained around a left driving wheel and a left idler wheel, the right crawler belt is trained around a right driving wheel and a right idler wheel, the left and right idler wheels are fixed on opposite ends of a front axle rotatably supported on the front portion of the vehicle body, the left electric motor is a geared motor mounted to the rear portion of the vehicle body on the left side of the vehicle body and having an output shaft on which the left driving wheel is fixed, and the right electric motor is a geared motor mounted to the rear portion of the vehicle body on the right side of the vehicle body and having an output shaft on which the right driving wheel is fixed.

6. The walk behind self-propelled crawler snowplow according to claim 5, wherein the front portion of the vehicle body has a horizontal slot extending in the longitudinal direction of the vehicle body and slidably receiving therein a longitudinal portion of the front axle, and a tension adjustment device is associated with the vehicle body and operative to move the front axle along the horizontal slot to thereby adjust a tension in the crawler belts.

7. The walk behind self-propelled crawler snowplow according to claim 1, wherein the vehicle body is composed of a propelling frame supporting thereon the left and right crawler belts and the left and right electric motors, a vehicle frame pivotally connected at a rear end portion thereof to a rear portion of the propelling frame and supporting thereon the snowplow mechanism and the engine, and a frame lift mechanism connected to the propelling frame and the vehicle frame and operable to move a front end portion of the vehicle frame up and down relative to the propelling frame.

8. The walk behind self-propelled crawler snowplow according to claim 7, wherein the frame lift mechanism comprises a cylinder actuator having a cylinder tube pivotally connected to the propelling frame and a reciprocating piston rod pivotally connected to the vehicle frame.

9. The walk behind self-propelled crawler snowplow according to claim 7, wherein the left crawler belt is trained around a left driving wheel and a left idler wheel, the right crawler belt is trained around a right driving wheel and a right idler wheel, the left and right idler wheels are fixed on opposite ends of a front axle rotatably supported on a front end portion of the propelling frame, the left electric motor is a geared motor mounted to a rear end portion of the propelling frame on the left side of the vehicle body and having an output shaft on which the left driving wheel is fixed, and the right electric motor is a geared motor mounted to the rear end portion of the propelling frame on the right side of the vehicle body and having an output shaft on which the right driving wheel is fixed.

10. The walk behind self-propelled crawler snowplow according to claim 9, wherein the front end portion of the propelling frame has a horizontal slot extending in the longitudinal direction of the vehicle body and slidably receiving therein a longitudinal portion of the front axle, and a tension adjustment device is associated with the propelling frame and operative to move the front axle along the horizontal slot to thereby adjust a tension in the crawler belts.

11. The walk behind self-propelled crawler snowplow according to claim 7, further comprising a pair of left and right operation handlebars extending from the rear portion of the propelling frame obliquely upward in a rearward direction of the crawler snowplow, a control unit mounted to the operation handlebars at a higher level than the crawler belts for controlling operation of the electric motors, and a battery mounted to the operation handlebars at a higher level than the crawler belts for supplying electric power to the electric motors.

12. The walk behind self-propelled crawler snowplow according to claim 11, wherein the control unit and the battery are disposed in a vertical space defined between the left and right handlebars.

13. The walk behind self-propelled crawler snowplow according to claim 11, wherein the control unit is disposed above the battery.

* * * * *